US008166774B2

(12) United States Patent
Obrist et al.

(10) Patent No.: US 8,166,774 B2
(45) Date of Patent: May 1, 2012

(54) HEAT EXCHANGER WITH AN EXPANSION STAGE

(75) Inventors: Frank Obrist, Begrenz (AT); Peter Heyl, Köln (DE); Peter Kuhn, Weinheim (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 594 days.

(21) Appl. No.: 11/656,799

(22) Filed: Jan. 23, 2007

(65) Prior Publication Data

US 2007/0169509 A1 Jul. 26, 2007

(30) Foreign Application Priority Data

Jan. 25, 2006 (DE) ..... 10 2006 003 781

(51) Int. Cl.
*F25D 9/00* (2006.01)
*F25B 1/00* (2006.01)

(52) U.S. Cl. ..... 62/402; 62/498

(58) Field of Classification Search ..... 62/298, 62/506, 507, 501, 87, 114–116, 199, 238.4, 62/223, 402, 428, 498, 508, 527, 50.3, 88; 418/55, 55.1, 55.5, 227, 13, 82, 152, 158, 418/179, 268; 244/59; 123/204; 60/327, 60/407; 417/52, 95–97, 204, 244–254
See application file for complete search history.

(56) References Cited

U.S. PATENT DOCUMENTS

| | | | | |
|---|---|---|---|---|
| 3,937,034 | A * | 2/1976 | Eskeli | 62/401 |
| 3,956,904 | A * | 5/1976 | Edwards | 62/402 |
| 4,246,759 | A * | 1/1981 | Signoret | 62/77 |
| 5,136,854 | A * | 8/1992 | Abdelmalek | 62/116 |
| 5,761,921 | A * | 6/1998 | Hori et al. | 62/238.4 |
| 6,336,317 | B1 * | 1/2002 | Holtzapple et al. | 60/39.63 |
| 6,589,033 | B1 * | 7/2003 | Johnson et al. | 418/13 |
| 6,907,855 | B2 * | 6/2005 | Mueller | 123/246 |
| 2004/0003622 | A1 * | 1/2004 | Negishi | 62/402 |

FOREIGN PATENT DOCUMENTS

| | | |
|---|---|---|
| DE | 1 403 597 | 11/1968 |
| DE | 699 00 659 | 12/1999 |
| DE | 699 03 908 | 7/2000 |
| DE | 103 20 391 | 12/2004 |
| JP | 11-094379 | * 4/1999 |

* cited by examiner

*Primary Examiner* — Frantz Jules
*Assistant Examiner* — Emmanuel Duke
(74) *Attorney, Agent, or Firm* — Klaus J. Bach

(57) ABSTRACT

In a heat exchanger unit for conditioning a first fluid, particularly a refrigerant in an air conditioning system, including a heat exchanger, the heat exchanger includes first and second tube element units for heat exchange between a first fluid flowing through the tube elements and a second fluid flowing over the tube elements, wherein the first fluid is supplied first to the first tube element unit so as to flow upwardly therethrough and via an intermediate outlet connector to a compressor stage from where it is transferred to the top of the second tube element unit which is disposed above the first tube element unit and flows downwardly through the second tube element unit to an expansion stage wherein the energy released during expansion in the expansion stage is utilized for the compression of the first fluid in the compressor stage.

5 Claims, 4 Drawing Sheets

HEAT EXCHANGER WITH AN EXPANSION STAGE

BACKGROUND OF THE INVENTION

The invention resides in a heat exchanger unit for conditioning a first fluid, particularly a refrigerant of an air conditioning system, including a fluid-air heat exchanger which includes an inlet connector for supplying a first fluid to a tube element unit which extends in heat exchange with a second fluid flowing over the tubes of the tube element unit through the tubes of which the first fluid flows.

It is the object of the present invention to provide a heat exchanger of the above type wherein, in a simple and space-saving manner, the first fluid can be expanded and heat can be transferred in a simple and efficient manner. A further object is to provide a heat exchanger which facilitates the establishment of a refrigerant circuit with high efficiency.

SUMMARY OF THE INVENTION

In a heat exchanger unit for conditioning a first fluid, particularly a refrigerant, in an air conditioning system including a heat exchanger, the heat exchanger includes first and second tube element units for heat exchange between a first fluid flowing through the tube elements and a second fluid flowing over the tube elements, wherein the first fluid is supplied first to the first tube element unit so as to flow upwardly therethrough and, via an intermediate outlet connector, to a compressor stage from where it is transferred to the second tube element unit which is disposed above the first tube element unit and flows through the second tube element unit to an expansion stage wherein the energy released during expansion in the expansion stage is utilized for the compression of the first fluid in the compressor stage.

Preferably, a first cooling procedure occurs in the first tube element unit wherein heat is transferred from the first fluid to a air stream. Subsequently, the first fluid is compressed in the compressor stage. At a correspondingly increased pressure level then, in the second tube element unit, a second cooling procedure can be realized wherein the first fluid is further cooled. In accordance therewith, the first tube element unit and the second tube element unit preferably operate in different temperature ranges wherein these temperature ranges are adjustable by the admission temperatures of the air. After flowing through the second tube element unit, the first fluid can be expanded in the expansion stage in such a way that energy is transmitted from the expansion stage to the compression stage so as to facilitate an energy recuperation.

In a particular embodiment of the invention, the compressor stage and the expansion stage are arranged adjacent to one another and can be coupled for the transmission of a torque from an expansion device to a compression device. An adjacent arrangement of the compressor stage and the expansion stage makes a particularly space-saving arrangement of all essential components possible. Preferably, both stages are combined to a single construction unit. Furthermore, they can be coupled in a torque-transmitting manner at least under certain operating conditions.

In a specific embodiment of the invention concerning a vertical installation arrangement the first tube element unit is arranged below the second tube element unit. In this way, a space-saving arrangement of all components cooperating in accordance with the invention is facilitated, particularly a space saving arrangement of the compressor stage and the expansion stage and a geodetic pressure difference is established between the two tube element units. Alternatively, the first tube element unit could be arranged horizontally next to the second tube element unit.

In another embodiment of the invention, the first tube element unit and the second tube element unit form a common construction unit preferably in a square envelope volume. The common construction unit preferably includes an inlet area via which the second fluid is admitted to the first and the second tube element unit and which is large in relation to the side surface areas of the envelope volume.

In still another embodiment of the invention, the first tube element unit comprises, at least in sections thereof, horizontally arranged tube elements through which the first fluid can pass from the bottom to the top. With such an arrangement, the first fluid is kept in the first tube element unit preferably in a gaseous state. The first tube element unit therefore is to be provided with an intermediate outlet, which is arranged vertically above an inlet stub of the inlet connector or, respectively, above the whole inlet connector. Any distance between the intermediate outlet and an intermediate inlet to the second tube element unit can therefore be particularly small.

In a further embodiment of the invention, the second tube element unit is so designed that the first fluid can pass along at least sectionally horizontally arranged tube elements and vertically from the top to the bottom, wherein particularly the intermediate inlet is arranged at an upper section of the second tube element unit. With such an arrangement, the first fluid can flow in an at least partially liquid state through the second tube element unit wherein the flow through the second tube element unit is enhanced by gravity. Accordingly, the first fluid can be cooled down to particularly low temperatures. Finally, the outlet connector is arranged with its outlet disposed preferably at the lowest location of the second tube element unit.

In another embodiment of the invention, a second heat exchanger is provided downstream of the expansion stage for evaporating the first fluid. Downstream of the second heat exchanger finally a refrigerant compressor may be arranged which has an outlet via which it is in communication directly or indirectly with the heat exchanger unit according to the invention. In this way, a closed particularly simple refrigerant circuit with high energy efficiency is formed.

Furthermore, a transmission pipe extends between the compressor stage and the intermediate inlet which transmission pipe is arranged outside the fluid-air heat exchanger. The transmission pipe may have a favorable wall thickness and a favorable flow cross-section wherein, via the transmission pipe, a certain distance between the compressor stage and the intermediate inlet can be bridged. The transmission pipe consequently facilitates an arrangement of the compressor stage and the expansion stage directly adjacent each other and in a very small space, particularly in a common housing.

Preferably, as noted, the compressor stage and the expansion stage are arranged in a common housing which includes an insulating separation wall which is disposed between a compressor wheel and an expansion stage wheel and which abuts the compressor wheel and the expansion stage wheel. Advantageously, the insulating separation wall delimits, on one side, a compressor space of the compressor stage and, on the other side, an expansion space of the expansion stage. At the same time, the insulating separation wall limits a heat transfer between the compressor stage and the expansion stage. Preferably, the insulating separation wall consists of a ceramic or a plastic material.

Furthermore, the compressor stage and the expansion stage have a common shaft with a compressor wheel or an expansion stage wheel slidably supported on the common shaft.

Preferably, the other wheel is firmly mounted on the common shaft for rotation therewith and is not axially movable. The arrangement includes a spring element which directly or indirectly biases the axially movably supported wheel toward the wheel which is fixed on the common shaft. In this connection, it is particularly advantageous if the insulating separation wall is movably supported in the housing so that the separation wall can be biased, together with the axially slidably supported wheel, toward the wheel which is fixedly supported on the common shaft.

Preferably, the expansion stage has a variable expansion volume wherein the internal expansion of the first fluid can take place. Furthermore, the compressor, stage has a variable compressor volume for an internal compression of the first fluid. An internal expansion for the removal of energy out of the refrigeration process and an internal compression for the introduction of energy to the refrigeration process facilitates a particularly advantageous recuperation of potential energy by a direct transmission of mechanical energy from the expansion stage to the compressor stage. Accordingly, the efficiency of the respective refrigeration process is increased. For the realization of an inner expansion or, respectively, the realization of an inner compression, preferably pistons are movably arranged in an operating space so as to provide a variable expansion volume by increasing an expansion space and, respectively, a variable compressor volume by reducing a compression space for the transfer of potential energy.

In still another embodiment of the invention, the expansion stage and the compression stage each include an inner wheel supported on common shaft and an outer wheel supported in a housing and disposed around the inner wheel. In the arrangement, the inner wheel includes an outer gear structure and the outer wheel includes a corresponding internal gear structure in engagement with the outer gear structure and the inner wheel and the outer wheel are rotatable supported so as to be rotatable about two spaced axes of rotation. The inner wheel and the outer wheel operate jointly as first and second compressor wheel or, respectively, first and second expansion stage wheel. Both stages therefore have an inside axis design with two compression stage wheels or, respectively, expansion stage wheels, which are particularly compact and cost-effective to manufacture. Preferably, a common shaft is provided on which both inner wheels are supported. For supporting the respective outer wheel, preferably, a separate slide member is provided which, on one hand, abuts the housing and, on the other hand, abuts an outer wheel via a slide contact member of small dimensions. The slide contact member is arranged in each case in the area where, during operation, the force resultant reaches the outer wheel.

The invention will become more readily apparent from the following description thereof on the basis of the accompanying drawings.

DESCRIPTION OF PREFERRED EMBODIMENTS

Figure 1:
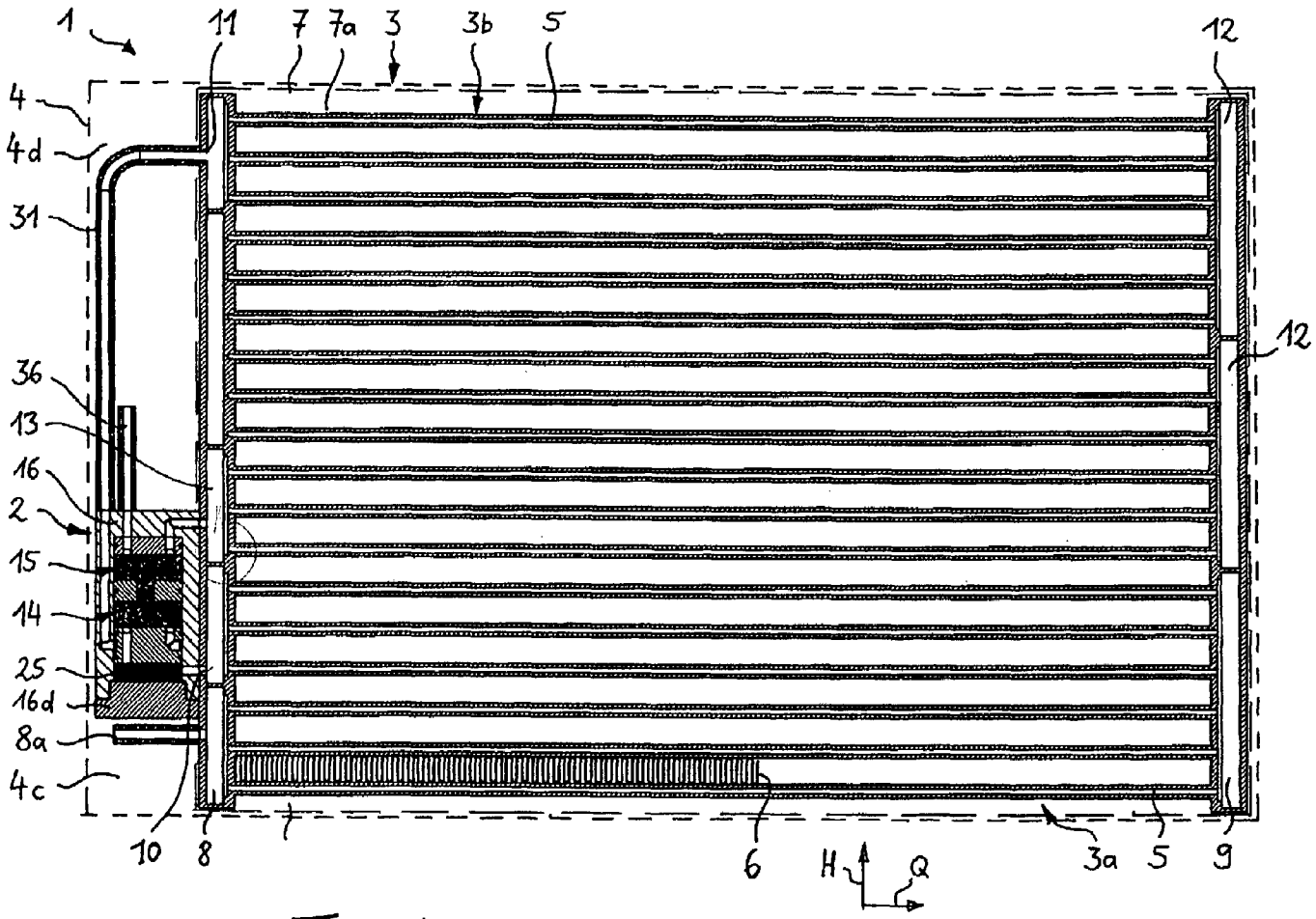
FIG. 1 is a longitudinal cross-sectional view of an expansion stage/compressor heat exchanger unit according to the invention, which is part of a cooling circuit as shown schematically in FIG. 5
Figure 2:
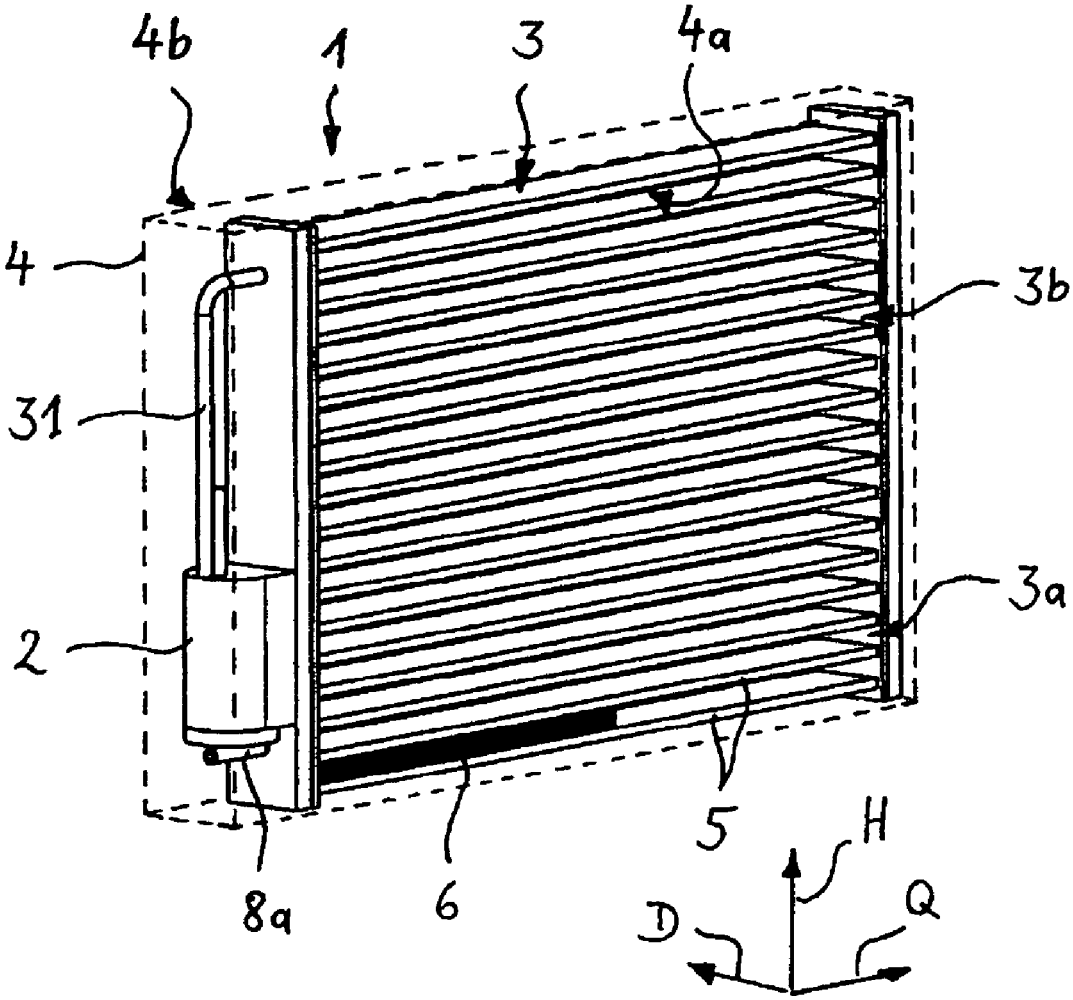
FIG. 2 shows the heat exchanger unit of FIG. 1 in a perspective representation.

A heat exchanger unit 1 in a motor vehicle air conditioning system comprises according to FIG. 1 and FIG. 2 a fluid-air heat exchanger 3 and an expansion stage/compressor unit 2, which are arranged in a common cubicle envelope volume 4. The heat exchanger unit particularly provides for heat exchange between a first fluid and a second fluid in the form of ambient air, wherein the first fluid is specifically a refrigerant of a refrigerant circuit of an air conditioning system, which is not shown. Such a refrigerant circuit comprises a refrigerant compressor, in which gaseous refrigerant is compressed and pumped to the heat exchanger unit according to the invention which is connected to the refrigerant compressor. Downstream of the heat exchanger unit according to the invention, there is a second heat exchanger in which—in a refrigeration process—liquid refrigerant is evaporated. Following the second heat exchanger, the refrigerant circuit may include a collection unit, in which gaseous refrigerant is separated from the liquid refrigerant and again supplied to the refrigerant compressor. In this way, a closed refrigerant circuit of a particularly simple design is provided. It is evident that the refrigerant circuit can be operated in both directions (heat pump).

In a modified embodiment, a heat exchanger unit according to the invention is provided in a refrigerant circuit of a mobile or a stationary cooling system and/or heat pump. In a further modified embodiment, instead of air, another gaseous and/or liquid second fluid is provided for the heat exchanger unit. In still another embodiment, the fluid-air-heat exchanger is designed for the passage of at least three physically and/or chemically different fluids.

The common envelope 4 has a comparably large front area 4*a*, which extends in an essentially vertical plane with a vertical axis H and a transverse axis Q—and through which one or more air (and if applicable a third fluid) flows in a direction of the admission flow axis D. In accordance, therewith the fluid-air heat exchanger 3 is designed to permit passage for the respective air flow in the direction of the flow axis D for the respective air flows. At a second front area 4*b*, which is disposed opposite the first front area 4*a*, the air flows can be conducted out of the fluid air heat exchanger 3.

In accordance with the invention, the fluid-air heat exchanger unit 3 includes a first tube element unit 3*a* and a second tube element unit 3*b* each of which includes a plurality of tube elements 5, which extend in the direction of the transverse axis Q. To provide for a certain guide path of the first fluid, the tube elements 5 extend primarily in the direction of the transverse axis Q, and a tube element 5 particularly with a flat profile is provided with one or several hollow spaces through which the first fluid flows. Between individual tube elements 5, preferably heat conducting heat transfer elements 6 are provided, for example fins, which are fixed to the tube elements 5 in heat transfer relation therewith. FIGS. 1 and 2 show only a part of the heat transfer elements arranged between the tube elements. Particularly, in the flow-through direction D, the second and/or third fluids flow over the tube elements 5.

The first tube element unit 3*a* is arranged within a squared envelope volume 7, which surrounds the tube element units, directly below the second tube element unit 3*b*. Preferably, the first tube element unit 3*a* is assigned a first air flow and the second tube element unit 3*b* is assigned a second air flow, wherein the first air flow may have a higher temperature than the second air flow. In a modified embodiment, there is a continuous temperature differential over the air flows wherein the lowest temperature level is in a vertically upper area 7*a* of the tube element envelope volume 7.

The fluid-air-heat exchanger 3 includes in a lower area 4*c* of the envelope volume 4 furthermore an inlet connector 8 to which the first fluid is supplied via an inlet 8*a*. Via the inlet connector 8, the first fluid is supplied to the first tube element unit 3*a* from where the first fluid is distributed to a plurality of tube elements 5. As shown in FIG. 1, the tube elements 5 of the first tube element unit 3*a* are preferably so connected that the first fluid flows within the first tube element unit 3*a* to a first flow reverser 9, where the direction of the flow is reversed by 180° and is then conducted out of the first tube element unit via an intermediate outlet 10. By way of the first tube element unit 3*a*, the first fluid is transferred upwardly in the direction of the vertical axis to the intermediate outlet 10, which is arranged approximately above the inlet connector 8. Such an arrangement is preferably provided if the first fluid is gaseous within the first tube element unit under all operating conditions and, as a gas, can be moved upwardly through the first tube element unit 3*a*.

The fluid-air heat exchanger further includes in an upper area 4*d* of the common envelope volume 4 an intermediate inlet 11 by way of which the first fluid is supplied to the second tube element unit 3*b*. Shown herein are the tube elements 5 of the second tube element unit 3*b*, which are preferably so interconnected that the first fluid flows within the second tube element unit through several second flow reversers 12 in each of which it is redirected that is reversed by 180°. Finally, the first fluid is conducted out of the second tube element unit 3*b* via an outlet connector 13 from where it is discharged from the fluid-air-heat exchanger 3. Herein the outlet connector 13 is arranged with respect to the vertical axis H preferably at a level below the intermediate inlet 11 so that, during passage through the second tube element unit 3*b*, the first fluid follows a geodetic pressure differential. In particular, the outlet connector 13 is arranged in a lower section of the second tube element unit 3*b* and above the first tube element unit 3*a*. With such an arrangement, the fluid/air heat exchanger acquires a certain tolerance for the condensation of the first fluid when flowing through the second tube element unit.

As already mentioned, the fluid-air heat exchanger 3 is provided with an expansion stage/compressor unit 2, to which, via the intermediate outlet connector 10, the first fluid is supplied from the first tube element unit 3*a*, the second tube element unit 3*b* being arranged downstream of the expansion stage/compressor unit 2.

Figure 3:
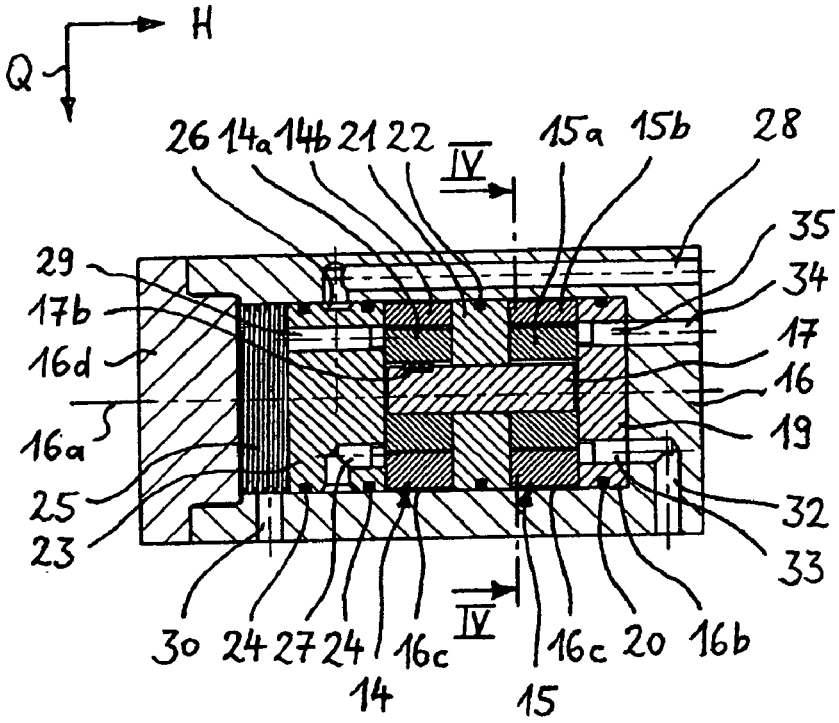
FIG. 3 shows the expansion stage/compressor unit of FIG. 1 in an enlarged longitudinal cross-sectional view taken along line III-III of FIG. 4.

The expansion stage/compressor unit 2 comprises in particular a compressor stage 14 and an expansion stage 15, which are arranged in a common pot-like housing 16 (see FIG. 3). In the direction of the flow axes D, the pot-like housing 16 has preferably the same width as the fluid air heat exchanger 3. In a modified embodiment, the expansion stage and the compressor unit are disposed in separate housings, but arranged adjacent each other. In another embodiment, the expansion stage and the compressor unit are coupled via a transmission and/or coupling unit for common rotation or they are designed so that they can be coupled. In particular, a coupling of the expansion stage and the compressor unit is provided which depends on the operating condition of the heat exchanger unit or, respectively, the motor vehicle air conditioning system. To this end, a control arrangement is provided which receives information concerning the operating state of the motor vehicle system and/or the heat exchanger unit from at least one sensor.

Figure 4:
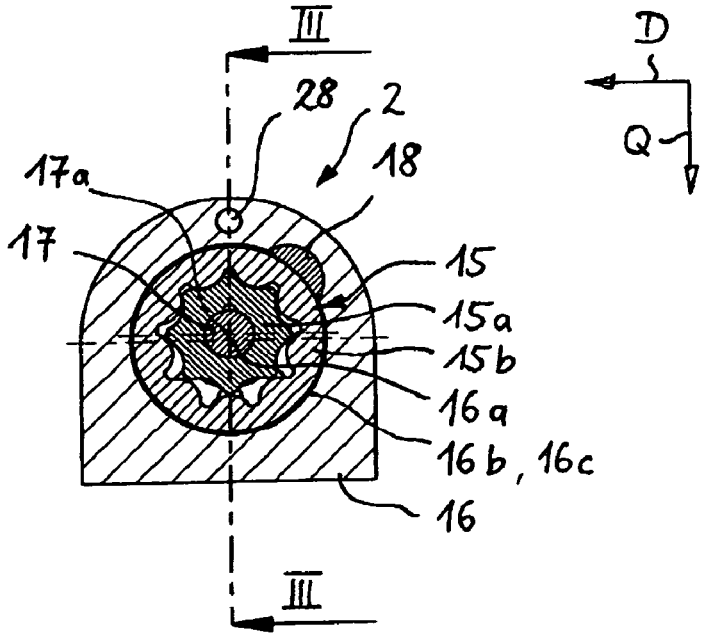
FIG. 4 is a cross-sectional view of the expansion stage/compressor unit taken along line IV-IV of FIG. 3.

The housing 16 includes several channels for the transfer of the first fluid which will be described below in greater detail on the basis of FIGS. 3 and 4. Within the housing 16, there is an essentially cylindrical hollow space 16*b* with a center axis 16*a*. A common shaft 17 is supported in the hollow space 16*b* rotatably about an eccentric axis 17*a* which is spaced from the center axis 16*a* by a certain constant distance. On the common shaft 17, an inner expansion stage wheel 15*a* is firmly supported with high accuracy and an inner compressor wheel 14*a* is axially slidably supported on the common shaft 17 via a spline-groove connection whereby rotation of the compressor wheel 14*a* relative to the common shaft 17 is prevented. Each of the expansion stage—and the compressor wheels 15*a*, 14*a* is disposed within an outer wheel, that is, an outer expansion stage wheel 15*b*, and respectively, an outer compressor wheel 14*b*. The outer expansion stage wheel 15*b* is provided with an inner tooth structure which is in engagement with a corresponding outer tooth structure of the inner expansion stage wheel 15*a*. The outer compressor wheel 14*b* is provided with an inner tooth structure which is in engagement with a corresponding outer tooth structure of the inner compressor wheel 14*a*. The outer wheels 14*b*, 15*b* are supported in the common housing 16 so as to be rotatable about the center axis 16*a*. In the area of the housing 16, where the force resultant reaches the housing, the housing 16 is provided with slide members 18, which provide sliding support for the outer wheels 14*b* and, respectively, 15*b* in the housing 16. The slide members provide for a comparatively small sliding support surface for sliding support of the outer wheels 14*b*, 15*b*, while the housing 16 provides for an annular lubrication gap 16*c* in the remaining areas between the outer wheels 14*b*, 15*b* and the housing 16.

In the area of a front face between the elements of the expansion stage 15 and the housing 16, a first, preferably metallic or ceramic, support element 19 is provided which includes at least one circumferential seal ring 20 and which supports the inner expansion stage wheel 15*a* as well as the outer expansion stage wheel 15*b* in axial direction. Between the expansion stage 15 and the compression stage 14, an insulating separation wall 21 is axially movably supported in the housing 16 in contact with the compression stage wheels 14*a*, 14*b* and with the expansion stage wheels 15*a*, 15*b*. The insulating separation wall 21 consists preferably of a material with low heat conductivity particularly of a plastic or ceramic material. The insulating separation wall 21 is provided with at least one circumferential seal ring 22 disposed in a circumferential groove.

In the area of a second front wall of the housing 16, a housing lid 16*d* is threaded into the housing 16 for closing the housing. Between the housing lid 16*d* and the compressor stage 14, a second support element 23 is provided which is axially in contact with the compressor wheels 14*a*, 14*b* and which is biased toward the compressor wheels 14*a*, 14*b* by a compression spring 25 disposed between the support element 23 and the housing lid 16*d*. The support element 23 includes at least two circumferential grooves in which seal rings 24 are disposed. Between the two seal rings 24, a further circumferential groove 26 is provided which is in communication with a first discharge channel 27 of the compressor stage 14 and a second discharge channel 28 for conducting the first fluid out of the common housing 16.

The second discharge channel 28 is in the form of a bore extending through the housing 16. About symmetrically across from the discharge channel 27, the support element 23 includes a first inlet channel 29 of the compressor stage 14 which is in communication, via the space accommodating the spring 25, with a second inlet channel 30 of the compression stage. The second inlet channel 30 is preferably arranged adjacent the intermediate outlet connector 10 of the fluid/air heat exchanger or it is formed integrally therewith. In a modified embodiment, a transfer duct is arranged between the intermediate outlet connector 10 and the second inlet channel 30. In either case, the first fluid discharged from the fluid-air heat exchanger into the intermediate outlet connector 10 is fed via the inlet channels 29, 30 into the compressor stage 14, wherein the first fluid is compressed via the compressor wheels 14*a*, 14*b* which are in engagement with each other. Subsequently, the first fluid is conducted out of the housing 16 via the discharge channels 27, 28 and into a transfer duct 31 (see FIG. 1) to the intermediate inlet connector 11.

After passing through the second tube element unit 3*b*, the first fluid reaches, via the outlet connector 13, a third inlet channel 32 arranged in the housing 16 and a fourth inlet channel 33 arranged in the support element 19. Via the third and fourth inlet channels 32, 33, the first fluid is admitted to the expansion stage 15 in which it is expanded while providing to the expansion stage wheels 15*a*, 15*b* potential energy and driving the expansion stage wheels 15*a*, 15*b*. On a side diametrically opposite to the inlet channels 32, 33, a third discharge channel 34 is arranged in the housing and a fourth discharge channel 35 is arranged in the first support element 19, which are in communication with each other at the low pressure side of the expansion stage 15 and which provide for a transfer of the expanded first fluid to a drain 36. Via the drain 36, the first fluid does not only leave the expansion stage/compressor unit 2, but the whole heat exchanger unit 1.

The energy recuperated in the expansion stage 15 is in accordance with the invention transferred by way of the common shaft 17 from the expansion stage 15 to the compressor stage 14. In this way, in the compressor stage 14, preferably a part of the compression work required for the refrigeration process is performed, that is the recuperated energy is internally utilized. In a modified embodiment, a fluid air heat exchanger may be provided with several expansion stage/compressor units via which a multistage expansion and a multistage compression can be provided. In a further modification, controllable transmission/coupling units may be provided between individual or several expansion stages and the respective compressor units.

Preferably, an expansion stage/compressor unit 2 is approximately of circular cylindrical shape and has a diameter corresponding about to the thickness of the fluid/air heat exchanger 3 in the direction of the flow passage diameter D. The axial length of the expansion stage/compressor unit 2 is less than the height of the fluid-air heat exchanger 3 in the direction of the vertical axis H. In this way, the expansion stage/compressor unit can advantageously be accommodated in the envelope volume 4.

With the heat exchanger unit according to the invention, by the use of simple means, the following procedures can be performed with the first fluid in the refrigeration process: Cooling, intermediate internal compression, further cooling and/or partial condensation, intermediate internal expansion. With the procedure which recuperates and internally utilizes the potential energy released during the expansion process, the refrigeration process has a particularly high efficiency. The arrangement according to the invention combines a multitude of components of a refrigeration apparatus in a common construction unit which can be utilized as a block with a particularly small squared envelope volume advantageously in motor vehicles or other refrigeration systems.

Figure 5:
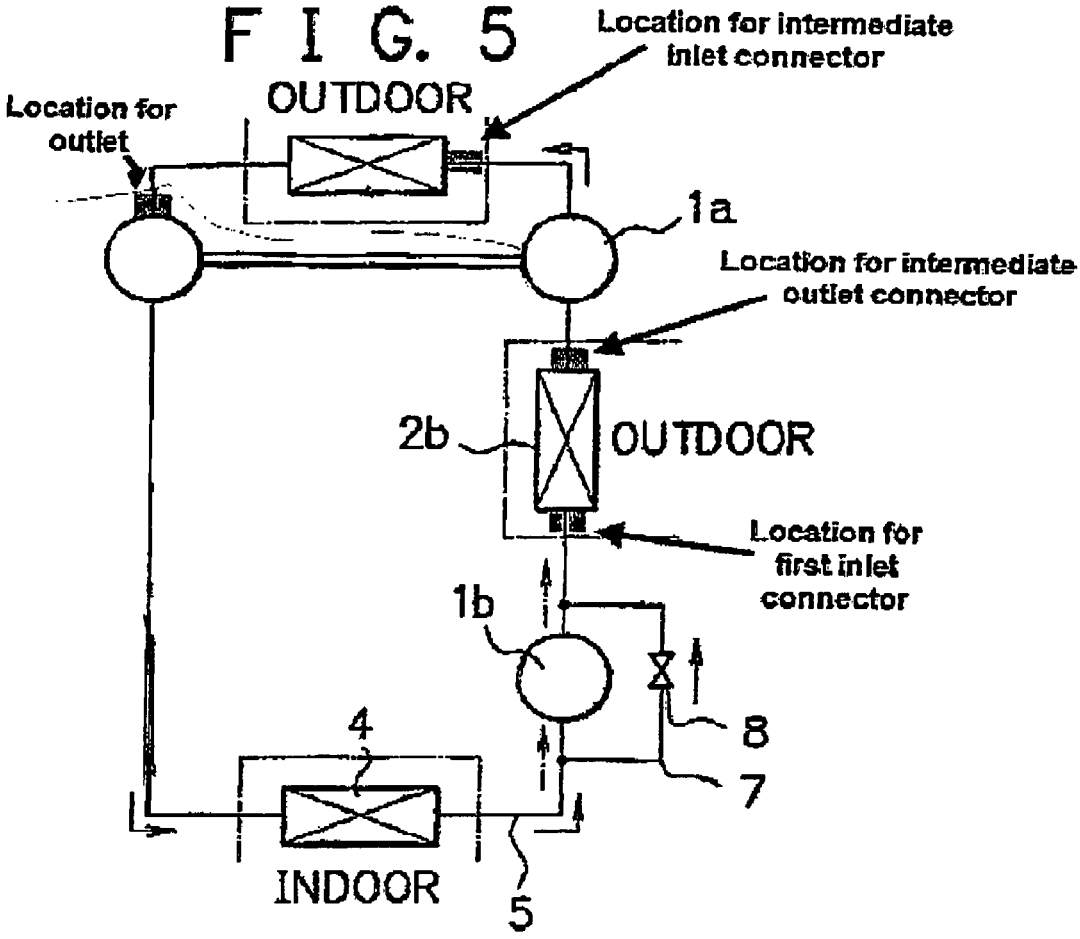
FIG. 5 shows schematically a cooling circuit including such an expansion stage/compressor heat exchanger unit.

FIG. 5 shows the whole refrigeration circuit including a compressor K, the expansion stage/compressor heat exchanger unit 1 for the condensation of the compressed refrigerant and its expansion in the in the expansion stage 15 and a second heat exchanger W for the heating of the expanded refrigerant and also a gas-liquid separator S. In this arrangement the expansion energy is utilized for further compressing the gaseous refrigerant compressed in the compressor K and already partially cooled in the section 3*a* of the heat exchanger 3 whereby the energy efficiency of the system is substantially improved.

What is claimed is:

1. A heat transfer system including a first fluid-air heat exchanger unit (3) with a first tube element (3*a*) and a second tube element (3*b*) connected in series with the first tube element (3*a*), a main compressor (K) connected to the first tube element (3*a*) for compressing a refrigerant supplied to the first tube element (3*a*) to system operating pressure and thereby increasing its temperature to an operating temperature at which the refrigerant is supplied to said first tube element (3*a*), a compressor-expansion stage unit (2) arranged between the first and second tube elements (3*a*, 3*b*) and including a compression stage (14) connected to the first tube element (3*a*) for re-compressing the refrigerant from the first tube element (3*a*) in which the refrigerant has been cooled and lost pressure, before the refrigerant re-pressurized and reheated is supplied to the second tube element (3*b*), and an expansion stage (15) connected to the second tube element (3*b*) for receiving the refrigerant which has been cooled in the second tube unit (3*b*) and decompressing it to a low system pressure while recuperating expansion energy therefrom, the expansion stage (15) being operatively connected to the compression stage (14) for transferring the energy recuperated in the expansion stage (15) to the compression stage (14) for operating the compression stage and for efficient cooling of the refrigerant, the expansion stage (15) being connected to a second heat exchanger unit (W2) in which the refrigerant is heated again before being supplied directly, that is without intermediate heat exchanger to the main compressor (K), the compression stage (14) and the expansion stage (15) being arranged in a common housing (16) including a compression stage wheel arrangement (14*a*, 14*b*) and an expansion stage wheel arrangement (15*a*, 15*b*) and an insulating separation wall (21) slidably supported in the housing (16) between the compression stage wheel arrangement (14*a*, 14*b*) and the expansion stage wheel arrangement (15*a*, 15*b*) and in contact with the compressor and expansion stage wheel arrangements (14*a*, 14*b*; 15*a*, 15*b*); wherein the compression stage (14) and the expansion stage (15) bare a common shaft (17) carrying a compression stage wheel (14*a*) and an expansion stage wheel (15*a*), and one of the compression stage wheel (14*a*) and the expansion stage wheel (15*a*) is axially slidably supported on the common shaft (17); and a support element (23) provided axially in contact with the shaft (17) and the compressor wheels (14*a* 14*b*) by a compression spring (25) disposed between the support element (23) and the housing lid (16*d*) supported in the housing (16) and biased toward the compression stage wheel (14*a*, 14*b*).

2. The heat transfer system unit as claimed in claim 1, wherein the compression stage (14) and the expansion stage (15) are arranged directly adjacent to each other and are mechanically coupled for transferring the energy released in the expansion stage (15) to the compression stage (14) for the recompression of the refrigerant entering the compression stage (14) from the first tube element unit (3*a*).

3. The heat transfer circuit as claimed in claim 1, wherein, in a vertical installation orientation of the fluid-air heat exchanger (3), the first tube element (3*a*) is arranged below the second tube element (3*b*).

4. The heat transfer system as claimed in claim 1, wherein the expansion stage (15) includes a variable expansion volume in which an inner expansion of the first fluid takes place whereby energy is released and transmitted via the common shaft (17) to the compression stage (14), which also includes a variable volume in which an inner compression of the first fluid takes place using the energy released in the expansion stage (15).

5. The heat transfer system as claimed in claim 1, wherein each of the compression stage (14) and the expansion stage (15) includes an inner wheel (14*a*, 15*a*) supported on the common shaft (17) and an outer wheel (14*b*, 15*b*) rotatably supported in the common housing (16) and surrounding the respective inner wheels (14*a*, 15*a*), and the inner wheels (14*a*, 15*a*) have a circumferential outer tooth structure and the outer wheels (14*b*, 15*b*) have an inner tooth structure engaging the outer tooth structure of the inner wheels (14*a*, 14*b*), the axes of rotation of the inner wheel and the outer wheel being spaced from each other such that, at one side, the inner and outer wheels are in fitting engagement.

* * * * *